US005169127A

United States Patent [19]

Eynard

[11] Patent Number: 5,169,127

[45] Date of Patent: Dec. 8, 1992

[54] GUARD RAIL

[76] Inventor: Emile Eynard, 73270 Beaufort Sur Doron, France

[21] Appl. No.: 713,296

[22] Filed: Jun. 11, 1991

[51] Int. Cl.[5] ..... A01K 3/00

[52] U.S. Cl. ..... 256/13.1; 256/19; 248/66

[58] Field of Search ..... 256/13.1, 19; 248/66

[56] References Cited

U.S. PATENT DOCUMENTS 2,927,513 3/1960 Dove ..... 256/13.1
3,476,362 11/1969 Thompson ..... 256/13.1

FOREIGN PATENT DOCUMENTS 0184525 11/1986 European Pat. Off. .
0318405 5/1989 European Pat. Off. .
8906460 5/1989 Fed. Rep. of Germany .
2483542 12/1981 France .
2633319 6/1988 France .

*Primary Examiner*—Andrew V. Kundrat
*Attorney, Agent, or Firm*—Oliff & Berridge

[57] ABSTRACT

A guard rail has at least one horizontal rail composed of rail elements made of wood, and wooden posts coupled to the rail. Each post supports each of the two adjacent elements of the rail. Each element of the rail is provided with a metal connecting member at its ends for connection to the adjacent end of an adjacent element in the rail. The connecting member comprises at least one tubular, metal member retained approximately halfway in two recesses provided in each of the two adjacent ends of two successive elements of the rail.

22 Claims, 2 Drawing Sheets

GUARD RAIL

BACKGROUND OF THE INVENTION

1. Field of the Invention

The present invention relates to a guard rail designed to ensure highway safety for automobiles on roads and to prevent them from leaving the road.

2. Description of Related Art

European Patent 0 184 525 teaches a guard rail formed by at least one horizontal rail composed of wooden rail elements and wooden posts, each post supporting two adjacent rail elements. Each element is provided at its ends with a metal armature or member enabling it to be connected to the adjacent end of an adjacent rail element.

In the first embodiment described in this European patent, the rail is mounted on the tops of posts and its elements are connected end to end by means of a T-shaped metal plate whose arms are inserted into the vertical and axial slots of two adjacent rail elements and whose lower part is inserted into a vertical slot provided in the upper end of the associated post. Assembly is provided by means of bolts passing completely through the post, the rail elements, and the plate. However, the T-shaped metal plate used in these embodiments requires relatively long and expensive manufacture.

According to an improved embodiment of the above rail, the subject of the first addition application 88 09037 to French Patent 84 17688, whose priority was claimed at the time the above European patent was filed, each metal armature or member is composed of at least one shaped metal strap with longitudinal edges curved to have a U-shaped cross section. One part is mounted on the periphery of the end of a rail element essentially parallel to the axis of the latter by means of at least one transverse bolt and on the periphery of the adjacent end of the adjacent rail element by means of at least one transverse bolt. While the curved longitudinal edges wedged into the ends of two successive rail elements give this plate an improved moment of inertia and consequently a better bending strength than a flat piece of iron, this improvement is limited by the fact that the height of the curved longitudinal edges must remain limited since they must enter the rail elements.

SUMMARY OF THE INVENTION

The disadvantages of the prior art are overcome by the guard rail according to the present invention comprising at least one horizontal rail composed of wooden rail elements and by wooden posts each supporting two adjacent rail elements. Each rail element is provided at each of its ends with a metal connecting member providing connection to the adjacent end of an adjacent rail element. Each connecting member is composed of at least one metal tubular element, and each metal tubular element is embedded essentially halfway in two facing recesses hollowed out in the adjacent ends of the two successive rail elements.

BRIEF DESCRIPTION OF THE DRAWINGS

The invention will be clearly understood from the following description which refers to the attached schematic diagrams showing, as nonlimiting examples, three embodiments of the guard rail according to the present invention.

DETAILED DESCRIPTION OF THE INVENTION

Figure 1:
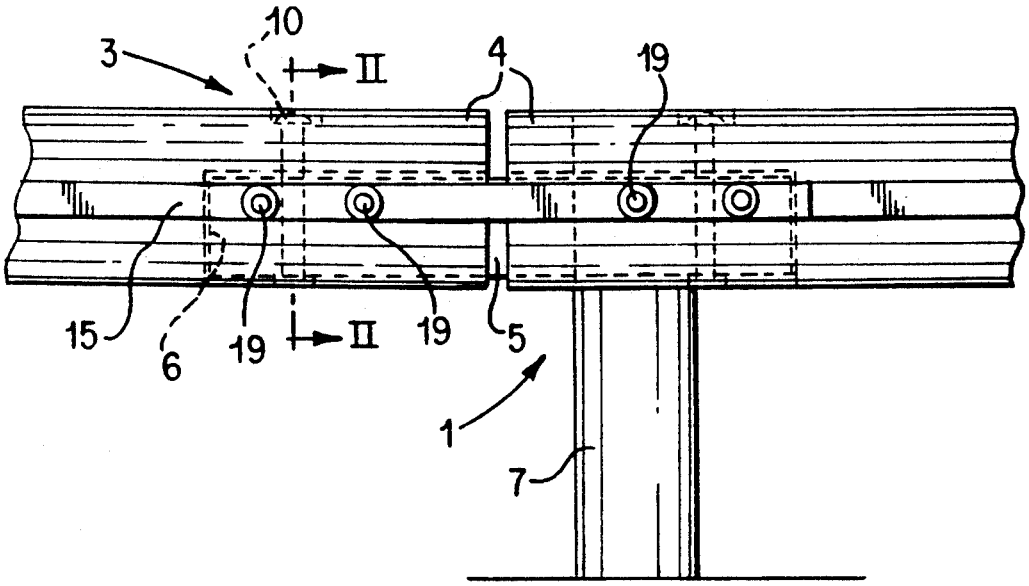
FIG. 1 is a side view of a portion of the guard rail according to a first embodiment.

The subject of the present invention is a guard rail which is easily demountable and which offers the possibility of easy replacement of various rails. Additionally, because of its simple design and because of the material of which it is made, the guard rail of the present invention has a relatively low cost while possessing outstanding properties of mechanical strength, especially bending and tensile strength, making it possible to avoid any discontinuity in the alignment of the various rails.

The guard rail according to the present invention comprises at least one horizontal rail composed of wooden rail elements and wooden posts each supporting two adjacent rail elements. Each rail element is provided at each of its ends with a metal connecting member providing connection to the adjacent end of an adjacent rail element. Each connecting member is composed of at least one metal tubular element, and each metal tubular element is embedded essentially halfway in two facing recesses hollowed out in the adjacent ends of the two successive rail elements.

Advantageously, each connecting member has a polygonal cross section, such as rectangular, and the recess in the end of each rail element has a matching cross section. The connecting member is located in the recess so that the member terminates in the essentially cylindrical wall of the rail element preferably in a substantially flush engagement.

The polygonal section, rectangular for example, of the connecting member provides good bending strength, greater than the strength of the flat metal plates disclosed in the above European patent and those whose longitudinal edges are curved, disclosed by the above first addition French application. The insertion of the connecting member into the recess of matching shape in the end of the corresponding rail element provides a very good connection between the several rail elements which consequently exhibit outstanding bending strength in the areas of these connections.

Moreover, the connecting member solidifies the connections between the rail elements because of the positioning inside the core of the rail elements. Further, the connecting member can be rendered invisible from the road along whose edge this rail is installed, to confer an appreciable aesthetic appearance to the guard rail. For this purpose, the recesses in the rail elements which receive the connecting members may terminate laterally in the rear or lower part of the rail elements. Thus, the removal and reinstallation of each rail element independently of the adjacent elements poses no problem.

According to another useful characteristic of the invention, a means of reinforcement in the form of a flat iron is provided. The strap covers the rail element laterally and extends its entire length. Covering the rail element laterally for its entire length increases the bending and impact strength of this rail.

According to another useful characteristic of the invention, each connecting member has at least two pairs of holes which are transverse and coaxial. The holes allow the passage of at least two bolts, each of which passes through one of the two rail elements joined by the connecting member.

According to one embodiment of the invention, each tubular connecting member has a circular cross section and each recess at the end of the rail element has a matching circular cross section and is located coaxially with the rail element. Advantageously in this embodiment, each end of each rail element has a radial slot that connects the corresponding central recess with the exterior of the rail element, and the central recess of at least one end of each rail element has a length twice that required to accommodate a connecting member. This recess is thus capable of receiving and accommodating the entire member during assembly or disassembly of the adjacent rail element. This arrangement therefore permits easy and rapid disassembly and replacement of one rail element of the guard rail without requiring removal of other rails or the connecting member. Thus, after removing the mounting bolts of the connecting member in question by simply inserting a mechanical device in the slot connecting the corresponding recess to the exterior, it is possible to slide the connecting member into the longest recess and consequently free the adjacent two rail elements of any connection.

FIG. 1 shows a guard rail assembly 1 according to a first embodiment of the present invention. Rail assembly 1 comprises a horizontal rail 3, composed of essentially cylindrical rail elements 4 made of wood, connected together end to end, and posts 7, likewise of wood, set firmly in the ground and supporting the rail elements 4 near their connecting areas. Elements 4 forming rail 3 have a length ranging between about 1 and 3 meters, generally about 2 to 3 meters, and a diameter ranging from about 100 to 300 mm, preferably about 150 to 250 mm. The dimensions of elements 4 of rail 3 are clearly determined as a function of the maximum permissible speed on roads equipped with these guard rails. Preferably each element 4 of rail 3 and each post 7 is made of wood, such as pine, fir, spruce, or larch, which has previously been subjected to suitable treatment, such as weatherproofing.

Figure 2:
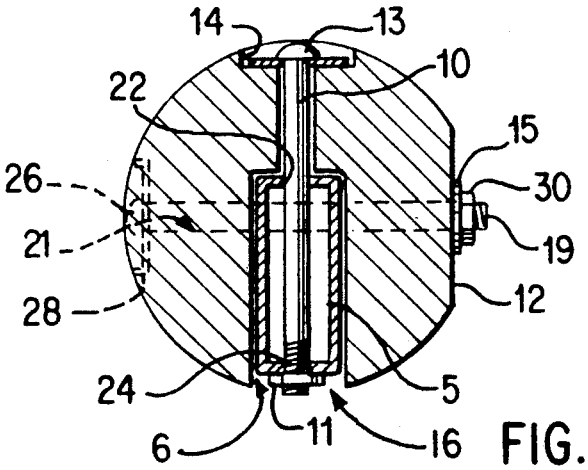
FIG. 2 is a cross section of the guard rail of FIG. 1 taken at line II—II in FIG. 1.

As shown in FIG. 1, each element 4 of rail 3 is provided at each of its ends with a metal armature or connecting member composed of a hollow rectangular member 5 permitting it to be connected to the adjacent end of an element 4 of adjacent rail 3. Each member 5 is a tubular metal element fitted halfway, as shown in FIG. 2, into two coaxial recesses 6 in two ends, placed end to end, of two successive adjacent elements 4 of rail 3. These recesses 6 are provided in the ends of elements 4 of rail 3.

In the embodiment shown in FIGS. 1 and 2, member 5 has a rectangular cross section, and recesses 6, provided in the ends of elements 4 of rail 3, each have a matching rectangular cross section and a length corresponding essentially to half that of member 5 to receive and accommodate approximately half of the member. In addition, each recess 6 is located so that it terminates in the lower part of the cylindrical wall of element 4 of rail 3.

The rectangular section of members 5 gives them good bending strength which is much better than that of the flat metal plates previously known. In addition, their insertion into a recess 6 at the end of element 4 of rail 3 of a matching shape provides a good connection between the different elements 4 of rail 3 avoiding any discontinuity in their alignment. Further, since recess 6 terminates in the lower or rear parts of the walls of elements 4 of rail 3, member 5 is invisible from the road at whose edge this rail is mounted, giving it an appreciable aesthetic appearance.

As FIG. 2 shows, each member 5 has two pairs of coaxial through holes 22 and 24 designed to accommodate two bolts 10 for joining members 5 to two adjacent elements 4 of rail 3. In the embodiment shown in FIGS. 1 and 2, the coaxial holes 22 and 24 of members 5 and bolts 10 which traverse them are vertical, while in the examples shown in FIGS. 3 to 7 the coaxial holes of the connecting members and the bolts traversing them are horizontal.

A flat iron plate or strap 15 is mounted laterally to each element 4 of rail 3 over its entire length by means of bolts 19 to improve its impact, bending, and tensile strength. Bolts 19 pass through bore 21 in rail element 4 and a pair of coaxial holes in member 5. To this end, a flat surface 12 is provided laterally over the entire length of each element 4 The connection between two consecutive flat iron plates 15 is ensured by overlapping their ends and traversing them by at least one horizontal bolt 19 as seen in FIG. 1.

In order for bolts 10 or 19 not to damage the appearance of the guard rail on the side visible from the road, nor to constitute dangerous projections, their ends holding nuts 11 and 30 respectively face away from the side opposite the road and their hemispherical heads 13 and 26 respectively are recessed in countersunk areas 14 and 28 respectively.

When members 5 have a rectangular cross section, as shown in FIGS. 1 to 5, removal of one element 4 of rail 3 which may have deteriorated is very easy to accomplish. It is sufficient to remove the corresponding bolts 10 and 19 if applicable and remove the deteriorated element 4 of rail 3 in the direction opposite that in which its recesses 6 terminate laterally, that is, to slide the element laterally away from the connecting member. The mounting of elements 4 of rail 3 on posts 7 is ensured near each member 5 by means of horizontal bolts 19 traversing one of the two elements 4 near its end, joined by member 5.

Figure 3:
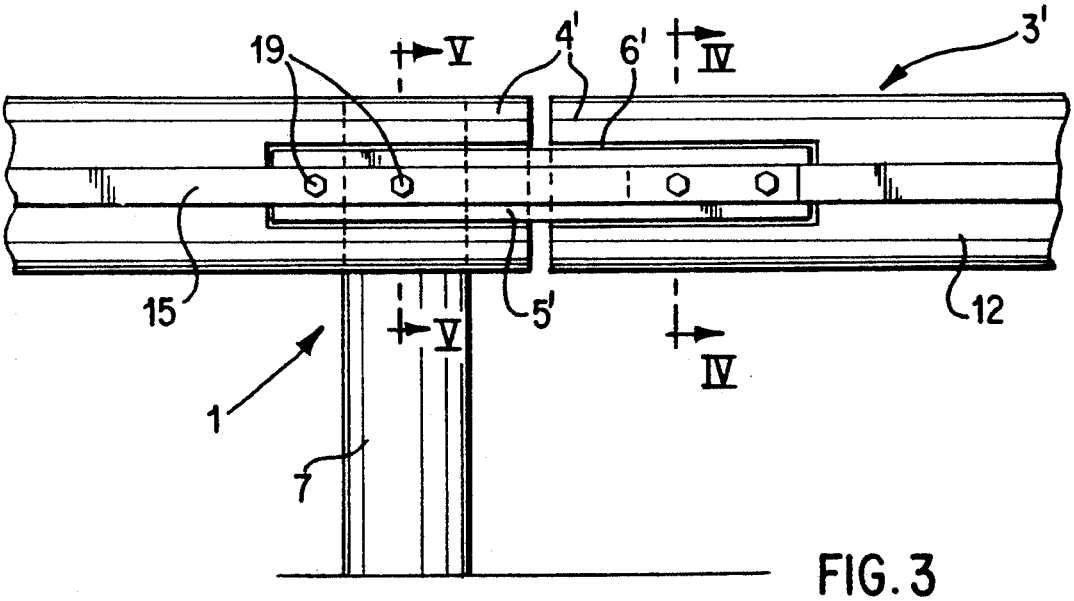
FIG. 3 is a view similar to FIG. 1 of a second embodiment of the guard rail.
Figure 4:
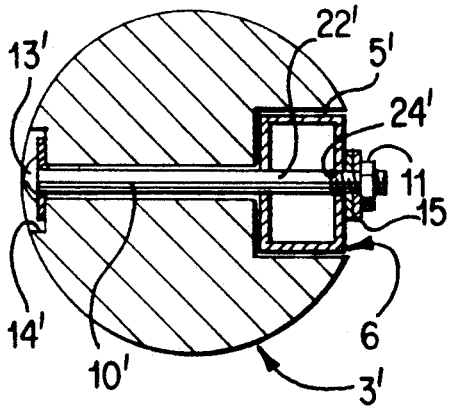
FIG. 4 is a cross section of the guard rail of FIG. 3 taken at line IV—IV in FIG. 3.
Figure 5:
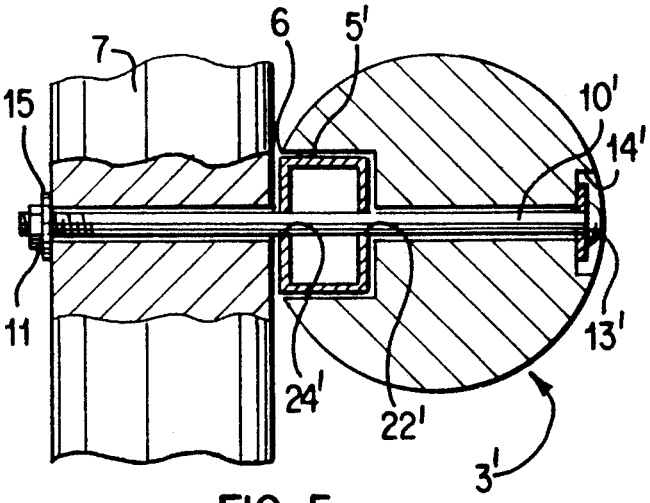
FIG. 5 is a cross section of the guard rail of FIG. 3 in partial section taken at line V—V in FIG. 3.

In the second embodiment shown in FIGS. 3 to 5, recesses 6' in the ends of elements 4' of rail 3' are located so that they terminate in the rear parts of the cylindrical walls of the rail elements.

In the embodiment shown in FIGS. 3–5, bolts 10', connecting the members 5' to the ends of elements 4' of rail 3', are horizontal and extend through apertures 22' and 24'. Additionally, one of the bolts 10' can be used to fasten rail 3' to post 7 and strap 15 to rail 3'.

Figure 6:
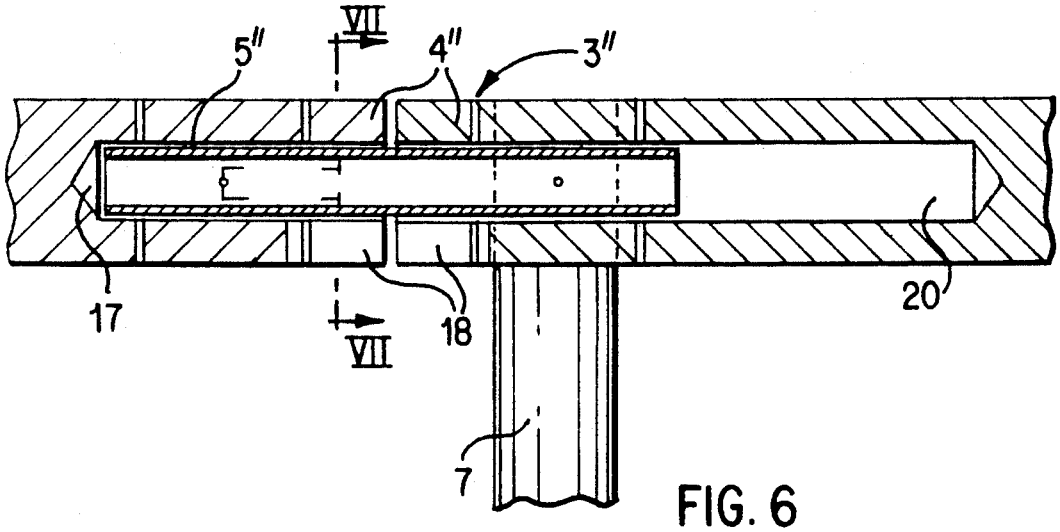
FIG. 6 is a side view in partial section of a guard rail similar to FIGS. 1 and 3 showing a third embodiment according to the present invention.
Figure 7:
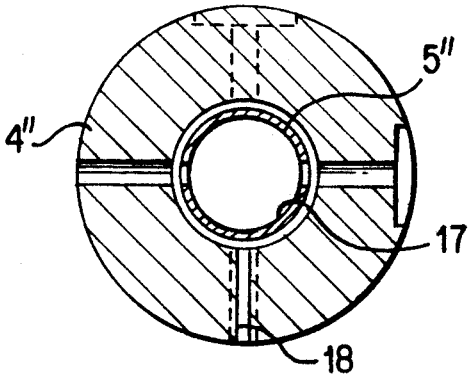
FIG. 7 is a cross section of the guard rail of FIG. 6 taken at line VII—VII in FIG. 6.

In the embodiment shown in FIGS. 6 and 7, connecting element or member 5'' has a tubular, circular cross section. Each member 5'' is intended to be inserted into two corresponding cylindrical recesses 17 and 20 each of which is pierced axially in the end of an element 4'' of rail 3''. Each recess 17 and 20 communicates with the exterior by a radial slot 18.

In addition, at least one of the recesses 20 of each element 4'' of rail 3'' has a length equal to twice that of the other, in other words equal to the length of a member 5''. This arrangement allows concealment of the entire member 5'' in this recess and considerably facilitates removal of a rail element 4'' of rail 3''. After removing the mounting means, by simple insertion of a suitable tool in slot 18 it is possible to slide the member 5'' into the longest recess 20 and thus completely separate this element 4'' and its neighbor from one another. This arrangement makes it possible to pull off one element 4'' of rail 3'' without having to remove all elements 4'' located between the latter and the closest end of the rail.

Of course all the slots, holes, and recesses of the different elements of rail assembly 1, including posts 7 and elements 4 of rail 3, can be made at the factory at the same time.

While the present invention is described with reference to preferred embodiments, these particular embodiments are intended to be illustrative, not limiting. Various modifications may be made without departing from the spirit and scope of the invention as defined in the appended claims.

What is claimed is:

1. A guard rail comprising:

at least one support post;

at least one rail made of wood coupled to said post, said rail including at least two adjacent solid rail elements with ends, each of said ends having an axial recess therein, wherein said recess has a radial slot opening to the exterior of the rail element; and a metal connector for coupling said adjacent rail elements together, said connector being tubular and substantially entirely received in both of said recesses of said adjacent rail elements.

2. A guard rail according to claim 1, wherein said connector is an elongate tube with a polygonal cross section.

3. A guard rail according to claim 2, wherein said connector is rectangular.

4. A guard rail according to claim 2, wherein said recess has a polygonal cross-section.

5. A guard rail according to claim 4, further comprising an elongate reinforcer coupled along each of said rail elements to provide longitudinal reinforcement to the guardrail.

6. A guard rail according to claim 1, wherein said connector has at least two pairs of coaxial transverse apertures for receiving fasteners for fastening each of said adjacent rail elements to said connector.

7. A guard rail according to claim 1, wherein said connector is an elongate tube with a circular cross section.

8. A guard rail according to claim 7, wherein said recess has a circular cross-section.

9. A guard rail according to claim 1, wherein said connector has at least two apertures therein for receiving fasteners.

10. A guard rail according to claim 1, wherein said connector fits substantially flushly within said adjacent rail elements.

11. A guard rail according to claim 1, wherein each of said recesses is adapted to receive at least approximately half of said connector therein.

12. A guard rail according to claim 1, wherein said recess is located at a surface of said rail element.

13. A guard rail according to claim 1, wherein said recess is located in a radially central portion of said rail element.

14. A guard rail according to claim 1, wherein one of said recesses is substantially the length of said connector.

15. A guard rail according to claim 1, further comprising at least one fastener for fastening said connector to said adjacent rail elements.

16. A guard rail according to claim 1, wherein each of said elements has a bore therethrough communicating with each said recess for receiving a fastener.

17. A guard rail according to claim 1, further comprising a fastener for fastening one of said rail elements to said connector and said post.

18. A guard rail according to claim 1, wherein said recesses and said connector are disposed adjacent a lower surface of said rail, and said post is coupled to a side surface of said rail.

19. A guard rail according to claim 1, wherein said recesses and said connector are disposed adjacent a side surface of said rail and said post is coupled to said side surface in direct contact with said connector.

20. A guard rail according to claim 19, wherein said connector has at least two pairs of coaxial transverse apertures for receiving fasteners for fastening each of said adjacent rail elements to said connector.

21. A guard rail according to claim 1, wherein said post is wood.

22. A guard rail comprising:

at least one support post;

at least one wooden rail coupled to said post, said rail including at least two adjacent solid rail elements with ends, at least one of said ends of each adjacent rail element having a generally central axial recess; and an elongate metal tubular connector substantially entirely axially received in said adjacent recesses for coupling said adjacent rail elements together.

* * * * *